US007503879B2

(12) United States Patent
Liao

(10) Patent No.: US 7,503,879 B2
(45) Date of Patent: Mar. 17, 2009

(54) STEPPER OF FITNESS EQUIPMENT

(75) Inventor: Hsueh-Sen Liao, Hsin-Chu Hsien (TW)

(73) Assignee: Hsin Lung Accessories Co., Ltd., Hsin-Chu Hsien (TW)

( * ) Notice: Subject to any disclaimer, the term of this patent is extended or adjusted under 35 U.S.C. 154(b) by 460 days.

(21) Appl. No.: 11/152,181

(22) Filed: Jun. 15, 2005

(65) Prior Publication Data

US 2005/0288156 A1 Dec. 29, 2005

(30) Foreign Application Priority Data

Jun. 25, 2004 (TW) ..... 93210046

(51) Int. Cl.
*A63B 22/04* (2006.01)
*A63B 21/012* (2006.01)

(52) U.S. Cl. ..... 482/52; 482/114

(58) Field of Classification Search ..... 482/51, 482/52–53, 114–119
See application file for complete search history.

(56) References Cited

U.S. PATENT DOCUMENTS

| | | | | |
|---|---|---|---|---|
| 4,600,187 | A * | 7/1986 | Schenker | 482/52 |
| 6,626,806 | B2 * | 9/2003 | Stevens | 482/114 |
| 6,692,410 | B1 * | 2/2004 | Lai | 482/52 |
| 2002/0147076 | A1 * | 10/2002 | Stevens | 482/52 |
| 2002/0155926 | A1 * | 10/2002 | Lat | 482/52 |
| 2005/0277518 | A1 * | 12/2005 | Fan | 482/52 |

* cited by examiner

*Primary Examiner*—Steve R Crow
(74) *Attorney, Agent, or Firm*—Troxell Law Office, PLLC

(57) ABSTRACT

A stepper including one short post extending downwardly from a toe end of each of two pedals and a sleeve being provided on a tail end of each short post. Both pedals being respectively mounted to a front lateral lever located on a bottom of a base. Both ends of the lever are capped. Both pedals alternatively swinging up and down with the lever as the axis allowing a wider swing angle for both pedals to effectively reduce the height of the base subject to force.

8 Claims, 5 Drawing Sheets

STEPPER OF FITNESS EQUIPMENT

BACKGROUND OF THE INVENTION (a) Field of the Invention

The present invention is related to a stepper, and more particularly to one that is simple to construct, and safe and reliable to operate while allowing both pedals to swing a predetermined angle.

(b) Description of the Prior Art

Whereas most fitness equipment generally available in the market simulate the motion patterns of outdoor sports, a user of the fitness equipment is confined to work out within a room while achieving the equivalent fitness results of the open air. For example, a stepper allows the user to alternatively tread on both pedals simulating a walking pattern to achieve a purposes of sports and staying fit.

As illustrated in FIG. 1, a stepper of the prior art is comprised of two pedals 20 having their front ends pivotally connected to a base 10. Both pedals 20 are further connected to a hydraulic cylinder 30 so to alternatively swing up and down by taking advantage of a damping force provided by the hydraulic cylinder 30 while maintaining the coordinated motions of both pedals. Furthermore, the hydraulic cylinder 30 provides a proper resistance to a swing of both pedals 20 thus demanding more force to be applied by the user.

The base 10 is provided with a front lever 11 and a rear lever 12, and both rods 11, 12 are connected at their centers to a central rod 13. A support 14 is upwardly disposed at a right angle from the center of the front lever 11. A shaft 15 protruding from each of two sides of the support 14 is provided for each pedal 20 to be axially mounted thereto. However, the construction of the base 10 tends to be complicated, and the base 10 is vulnerable to toppling over since it is subject to a force located only at a top of the support 14 while the force applied to both pedals 20 results in a shear concentrating between the shaft 15 and the support 14.

SUMMARY OF THE INVENTION

The primary purpose of the present invention is to provide an improved construction of the stepper, to simplify the structure of the base, and to lower a height where the force is applied making the stepper safer to use while allowing both pedals to have a greater swing angle by means of a short post improving the workout results. The present invention has a base and a pair of pedals. The base includes a front lever, a rear lever, a central rod connecting both centers of the front and the rear rods. In the present invention, a short post each extends downwardly from the toe end of the pedal, and a sleeve is disposed on the tail of the short post. Both pedals are axially mounted through the sleeves to the front lever in relation to both ends of the central rod and both ends of the front lever are respectively provided with a end cap to permit both pedals to swing up and down with the front lever as the axis.

DETAILED DESCRIPTION OF THE PREFERRED EMBODIMENTS

Figure 1:
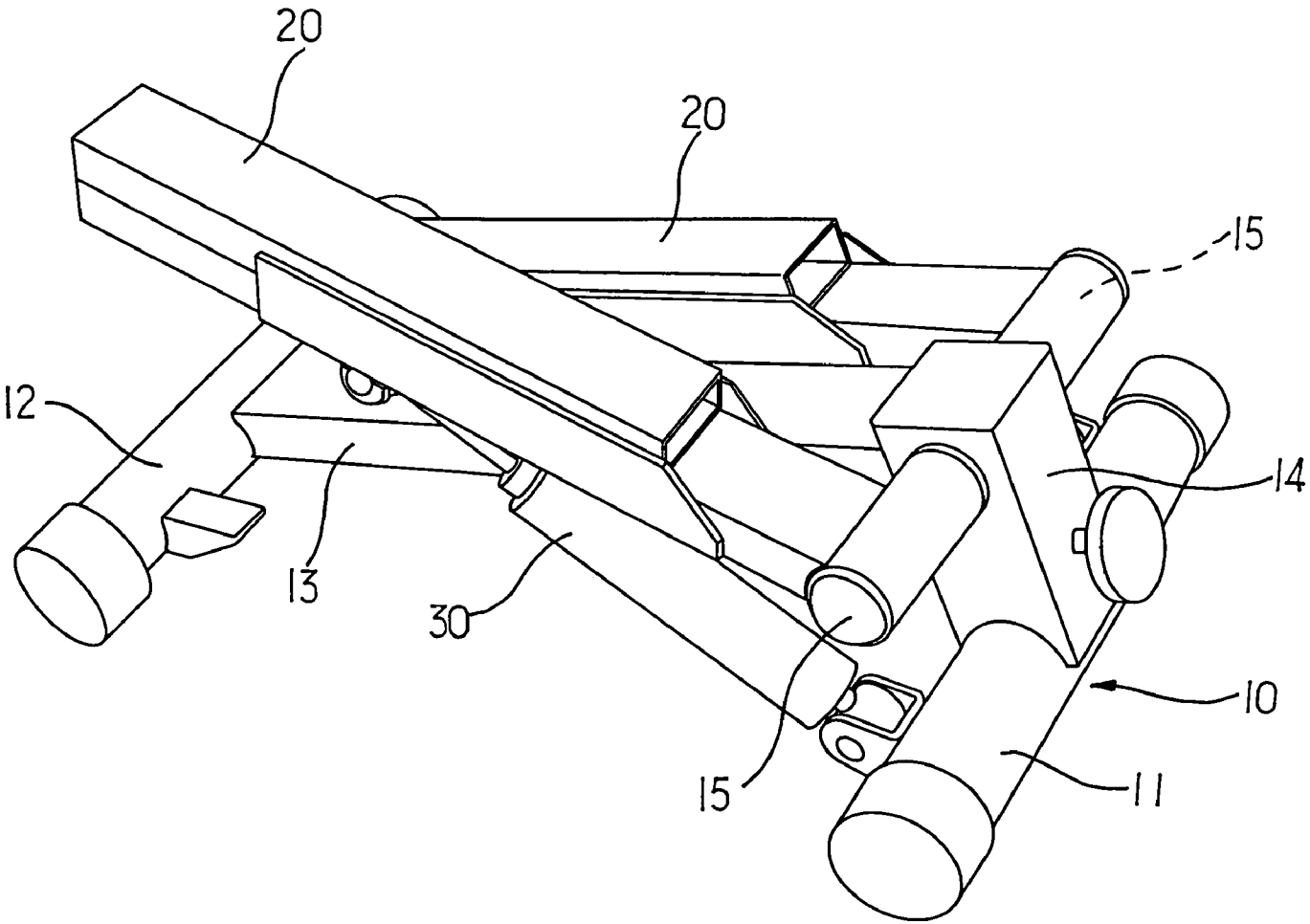
FIG.1 Prior Art
FIG. 1 is a perspective view of a stepper of the prior art.
Figure 2:
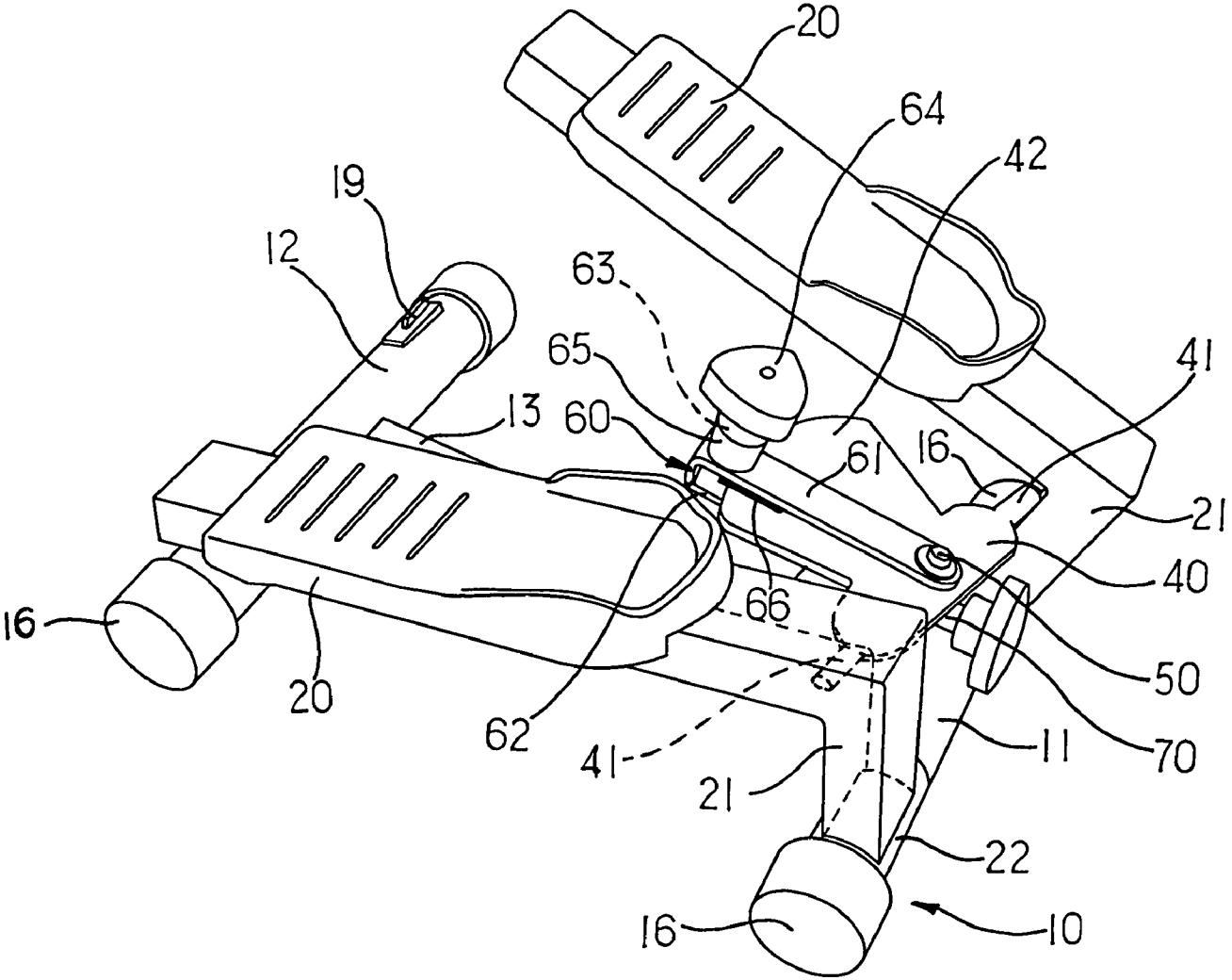
FIG. 2 is a perspective view of a stepper of the present invention.
Figure 3:
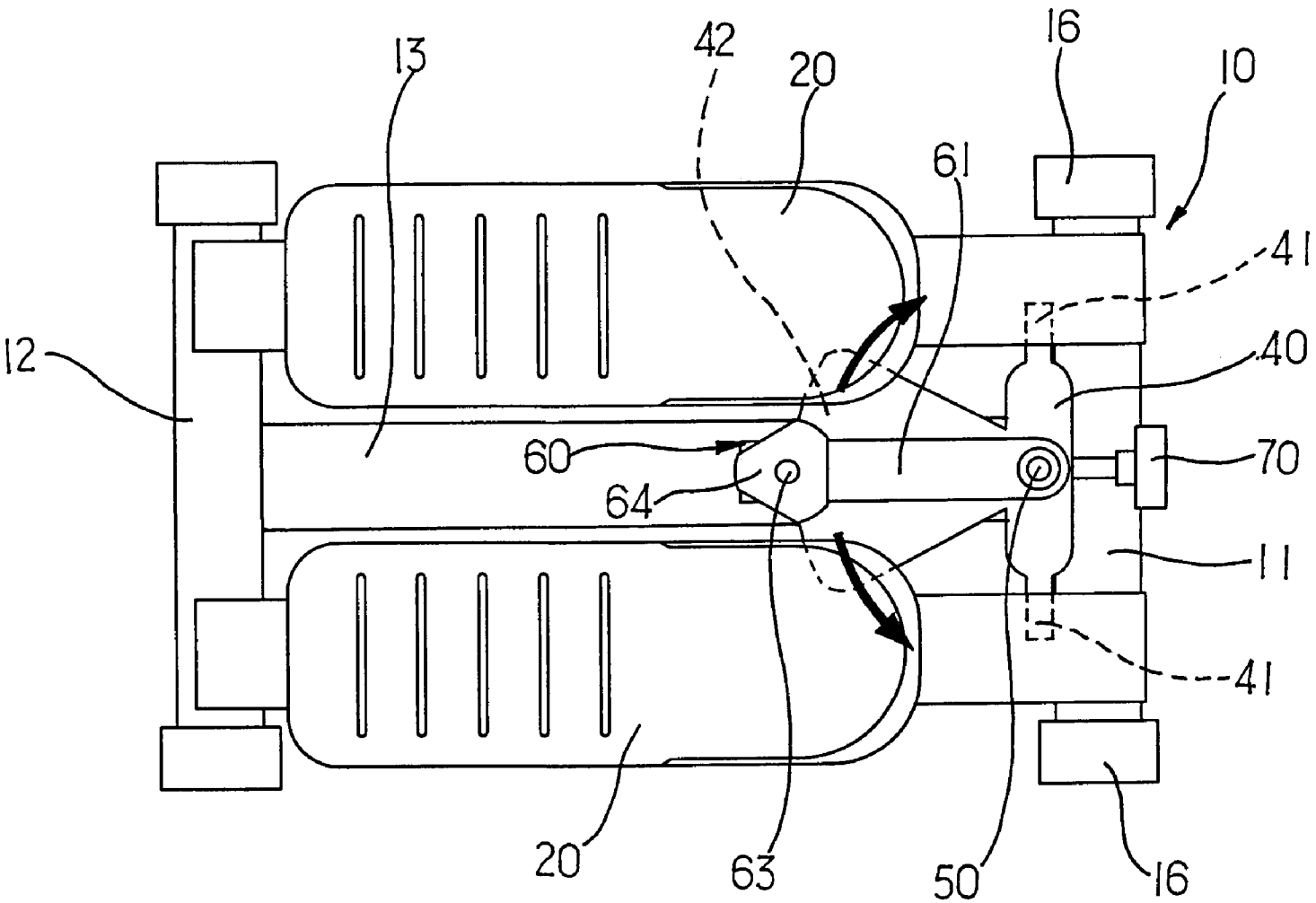
FIG. 3 is a schematic view showing a layout of the present invention.

FIG. 2 illustrates the basic construction of a preferred embodiment of the present invention including a base 10 axially provided with a pair of pedals linked to each other to swing up and down for simulating the walking pattern for staying fitness purpose. As illustrated in FIG. 3, a central rod 13 extends backward from a center of a front lever 11 of the base 10, and the tail of the central rod 13 is connected to a rear lever 12 corresponding to the front lever 11 to form a base that is firmly placed on the floor.

Figure 4:
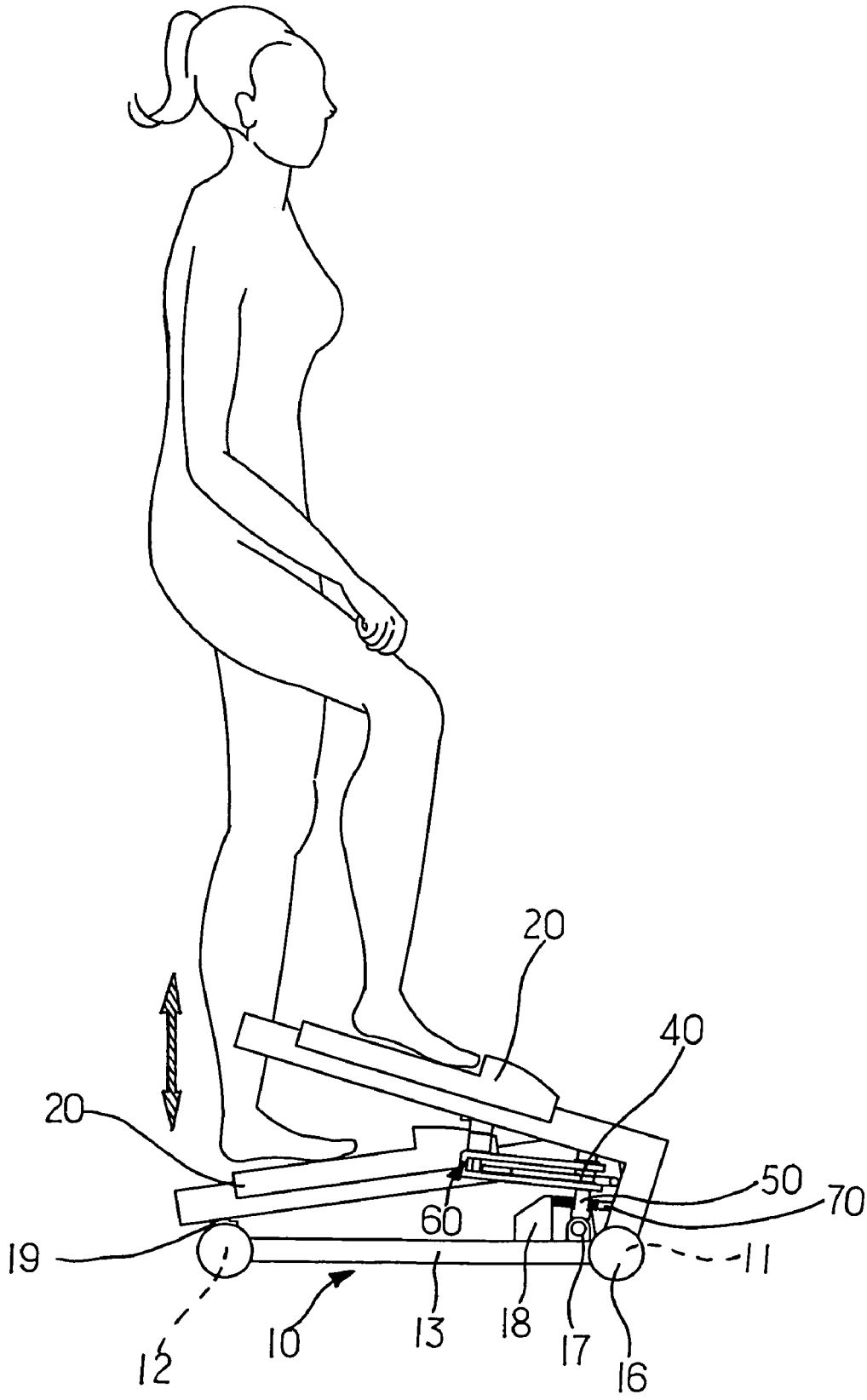
FIG. 4 is a schematic view showing an operation status of the present invention.

A short post 21 has a sleeve 22 extending downwardly and located on a toe end of the pedal 20. Both pedals are respectively and axially mounted to the front lever 11 by one of the respective sleeves 22 located on opposing ends of the central rod 13. In the preferred embodiment, a end cap 16 is located on each of two opposing ends of the front lever 11 to prevent the sleeve 22 of the pedal from contacting the ground so that both pedals 20, as illustrated in FIG. 4, alternatively swing up and down with the front lever as the axis. A cushion 19 is disposed on the rear lever 12 of the base in relation to the tail of the pedal 20. The cushion 19 is a rubber block or a coil to help absorb the impact resulted from the descending pedal 20.

Accordingly, in the present invention, the construction of the base 10 is simplified. The height of the location for the base 10 subject to the force applied is lowered making the stepper safer to use. Through the extension of the short post 21, both pedals are given wilder angle of swing to upgrade the workout results of the stepper.

Figure 5:
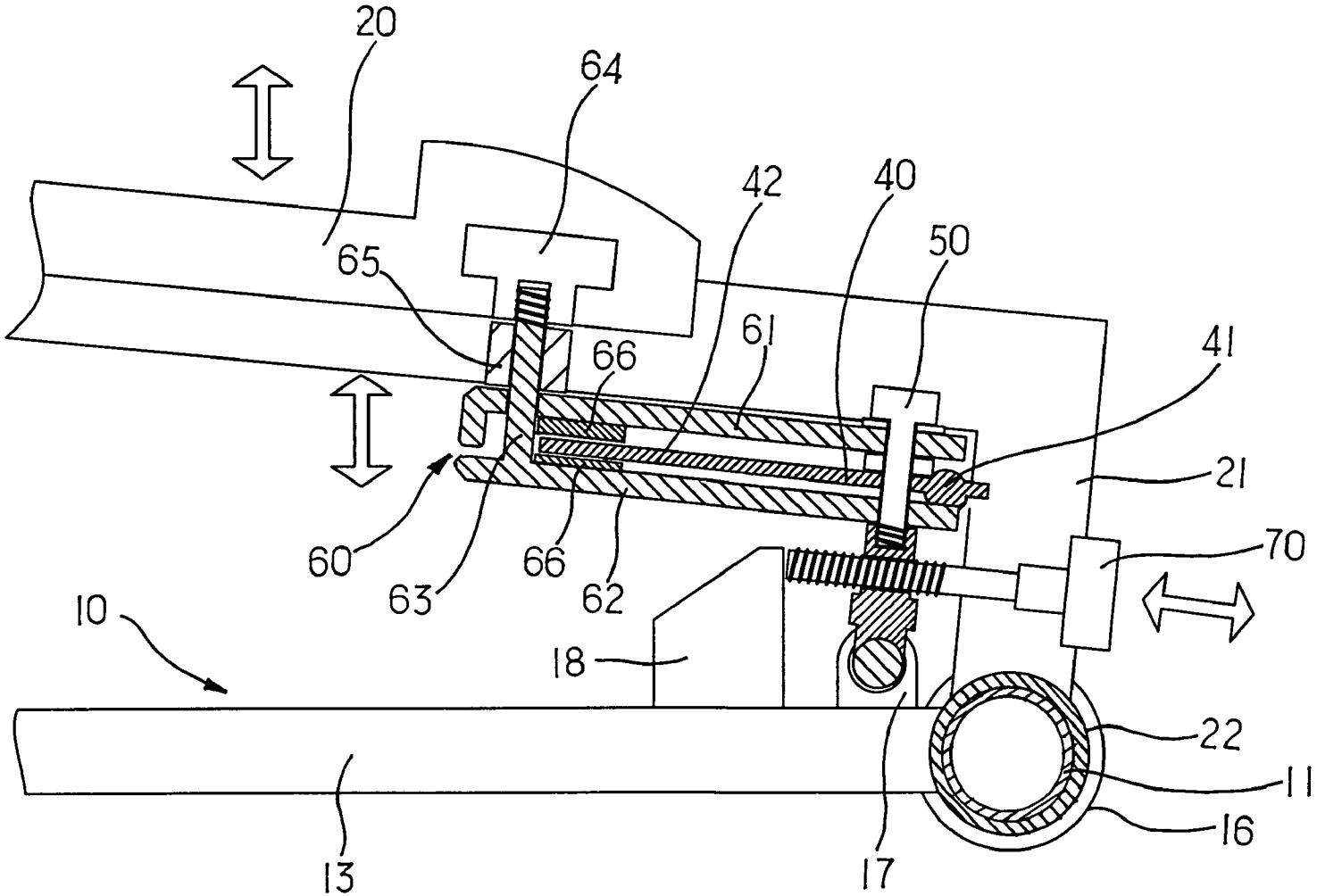
FIG. 5 is a sectional view of a central clamping member and a linking member of the present invention.

Furthermore, as illustrated in FIGS. 3 and 5, a linking member 40 is axially mounted to the central rod 13 of the base 10 and a connection rod 41 is coupled to each pedal 20 extends from opposing sides of the linking member 40 to facilitate the linkage between the linking member 40 and the pair of pedals 20. In the preferred embodiment, the linking member 40 is located between an upper clamping plate 61 and a lower clamping plate 62 of a clamping member 60. Both of the linking member 40 and the clamping member 60 are axially mounted to the central rod 13 of the base 10 by means of a shaft 50. An eyelet 17 is separately provided on the central rod 13 for the lower end of the shaft 50 to be pivoted to the central rod 13. A base plate 18 is disposed adjacent to the central rod in relation to the rear end of the shaft and a bolt 70 is screwed to the shaft 50. Both of the bolt 70 and the base plate 18 jointly push against the shaft 50 to change the height of the pair of pedals 20 by adjusting the angle of the shaft 50 through the bolt 70.

A resistance plate 42 extends from the linking member 40 in relation to the shaft 50, i.e., where the linking member is axially mounted. A clamping bolt 63 is disposed on the clamping member 60 on the side in relation to the resistance plate 42 to penetrate upwardly from the lower clamping plate 62 of the clamping member 60 and extending out of the upper clamping plate 61. A knob is fastened to the tail of the clamping bolt 63 and a resilient pad 65 being a rubber ring is provided between the knob 64 and the upper clamping plate 61. Two friction members 66 are respectively sandwiched by the upper clamping plate 61 and the lower clamping plate 62 and the resistance plate 42 to control the extent of clamping by both friction members 66 respectively from the upper clamping plate 61 and the lower clamping plates 62 by turning the knob 64, thus adjusting the force the user must apply upon the pair of the pedals 20.

The present invention provides an improved structure of a stepper, and the application for a utility patent is duly filed accordingly. However, it is to be noted that the preferred embodiments disclosed in the specification and the accompanying drawings are not limiting the present invention; and that any construction, installation, or characteristics that is same or similar to that of the present invention should fall within the scope of the purposes and claims of the present invention.

I claim:

1. A stepper of fitness equipment comprising:

a) a base having a front lever and a central rod extending rearwardly from a center of the front lever;

b) two pedals linked together, each of the two pedals is pivotally connected to the base to simulate walking by engaging in alternative motions up and down; each of the two pedals has a short post extending downwardly from a toe end thereof and a sleeve located on an end of the short post; one of two opposing ends of the front lever is inserted through each sleeve, the two pedals pivoting up and down with the front lever being the axis, and c) a linking member and a clamping member, the linking member is axially connected to the central rod of the base by a shaft, the linking member is mounted between upper and lower clamping plates of the clamping member, the linking member has a connection rod coupled to each of the two pedals and extending laterally from each of two opposing sides of a first end thereof and a resistance plate extending from the shaft to a second end of the linking member, a clamping bolt mounted between the upper and the lower clamping plates and located adjacent to the resistance plate, a knob being fastened to a tail of the clamping bolt; and the knob selectively adjusting a clamping force between the upper and the lower clamping plates and the resistance plate thereby controlling a force required to move the two pedals, wherein both the linking member and the clamping member are axially connected to the central rod by a shaft, the central rod has an eyelet and a base plate, the shaft is pivotally connected to the central rod by the eyelet, an adjustment bolt extending through the shaft and engaging the base plate, a working height of the two pedals is changed by adjusting an angle of the adjustment bolt penetrating through the shaft.

2. The stepper according to claim 1, wherein the clamping bolt penetrates through the clamping member from the lower clamping plate and extends upwardly through the upper clamping plate, and a resilient pad is disposed between the knob and the upper clamping plate.

3. The stepper according to claim 2, wherein the resilient pad is a rubber ring.

4. The stepper according to claim 1, further comprising a first friction member located between the upper clamping plate and the resistance plate, and a second friction member located between the lower clamping plate and the resistance plate.

5. The stepper according to claim 1, further comprising a rear lever corresponding to the front lever and connected to a tail end of the central rod of the base, and a cushion member located on the rear lever and corresponding to a tail end of the two pedals.

6. The stepper according to claim 5, wherein the cushion member is a rubber piece.

7. The stepper according to claim 1, wherein both ends of the front lever are capped.

8. The stepper according to claim 5, wherein both ends of the rear lever are capped.

* * * * *